US007150555B2

(12) United States Patent
Fang

(10) Patent No.: US 7,150,555 B2
(45) Date of Patent: Dec. 19, 2006

(54) LIGHTING PEN

(76) Inventor: Te-Hsiang Fang, No. 130, Lung Ping Road, San Chung, Taipei Hsien (TW)

( * ) Notice: Subject to any disclaimer, the term of this patent is extended or adjusted under 35 U.S.C. 154(b) by 0 days.

(21) Appl. No.: 10/867,689

(22) Filed: Jun. 16, 2004

(65) Prior Publication Data

US 2005/0254230 A1 Nov. 17, 2005

(30) Foreign Application Priority Data

May 17, 2004 (TW) ..... 93207657 U

(51) Int. Cl.
*B43K 29/10* (2006.01)

(52) U.S. Cl. ..... 362/579; 362/615; 362/619; 362/118

(58) Field of Classification Search ..... 362/579, 362/615, 619, 118; 40/334, 406, 409, 410, 40/905

See application file for complete search history.

(56) References Cited

U.S. PATENT DOCUMENTS 6,736,525 B1 * 5/2004 Chin ..... 362/249
2005/0201814 A1 * 9/2005 Oas ..... 401/195

* cited by examiner

*Primary Examiner*—John Anthony Ward
*Assistant Examiner*—Mark Tsidulko
(74) *Attorney, Agent, or Firm*—Troxell Law Office, PLLC

(57) ABSTRACT

The present invention discloses a lighting pen which comprises a writing section and an illustrating section on the bottom and in the middle section of the pen respectively, and a control switch for turning on and off an illuminating member; wherein a displaying section in the shape of a hollow tube is coupled adjacent to the illuminating section, and a light guiding plate is disposed on the inner wall of the tube, and at least one sign is disposed on the surface of the light guiding plate; such that the light passes through the light guiding plate and the sign is reflected on a predetermined position after the illuminating member is lit.

3 Claims, 4 Drawing Sheets

LIGHTING PEN

BACKGROUND OF THE INVENTION

1. Field of the Invention

The present invention relates to a lighting pen, more particularly to a pen capable of projecting a light onto a light guider of an exhibiting section after an illuminating section is lit and reflecting at least one sign onto the surface of the light guiding plate to achieve the advertising or publicity effect.

2. Description of the Related Art

As the science and technology advances, the applied materials and types of pens are getting more diversified with different functions. However, it is undeniable that the function of a pen has changed from simply a writing tool into an item accompanied with other functions, including the representation of the owner's social status and the advertising for promotions such as giving away as a promotional gift.

Regardless of representing a social status or promoting and advertising a product, the function of a pen is to show certain specific text and/or graphics and achieve the purpose of producing memory and recognition. Therefore, it is not difficult to find out that signs or logos with advertising and publicity effect are commonly found on the cap or the shaft of a pen.

However, the foregoing signs or logos in a textual form or a graphic form are usually printed onto the cap of a pen or a penholder by a thermal transfer printing method or a screen printing method. However, the conventional way of printing has a shortcoming on its limitation of statically displaying the signs or logos on a plane, which is a boring way of showing the signs or logos, and having no way of dynamically display the signs or logos. Therefore, the advertising or publicity effects so obtained are very limited.

On the other hand, the U.S. Design No. D 484,535 entitled "Lighting Pen" issued to the present invention disclosed a pen having a light guiding shaft at the top of an illuminating section disposed at the middle section of the pen and a bundle of optical fiber wires bundled into a coil, so that after the illuminating section is lit, a special and interesting light guiding effect is produced at the optical fiber wires. Therefore, products of this sort gain a good reputation from consumers after being introduced into the market.

SUMMARY OF THE INVENTION

In view of the description above, the inventor of the present invention based on years of experience on designing and marketing pens to conduct experiments and tests to improve the prior art as disclosed in the U.S. Pat. No. D 484,535 S and finally invented the "Lighting pen" having the illuminating, advertising, and publicity effects in accordance with the present invention.

The primary objective of the present invention is to provide a lighting pen which comprises a writing section and an illustrating section on the bottom and in the middle section of the pen respectively, and a control switch for turning on and off an illuminating member; wherein a displaying section in the shape of a hollow tube is coupled adjacent to the illuminating section, and a light guiding plate is disposed on the inner wall of the tube, and at least one sign is disposed on the surface of the light guiding plate; such that the light passes through the light guiding plate and the sign is reflected on a predetermined position after the illuminating member is lit.

BRIEF DESCRIPTION OF THE DRAWINGS

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

Figure 1:
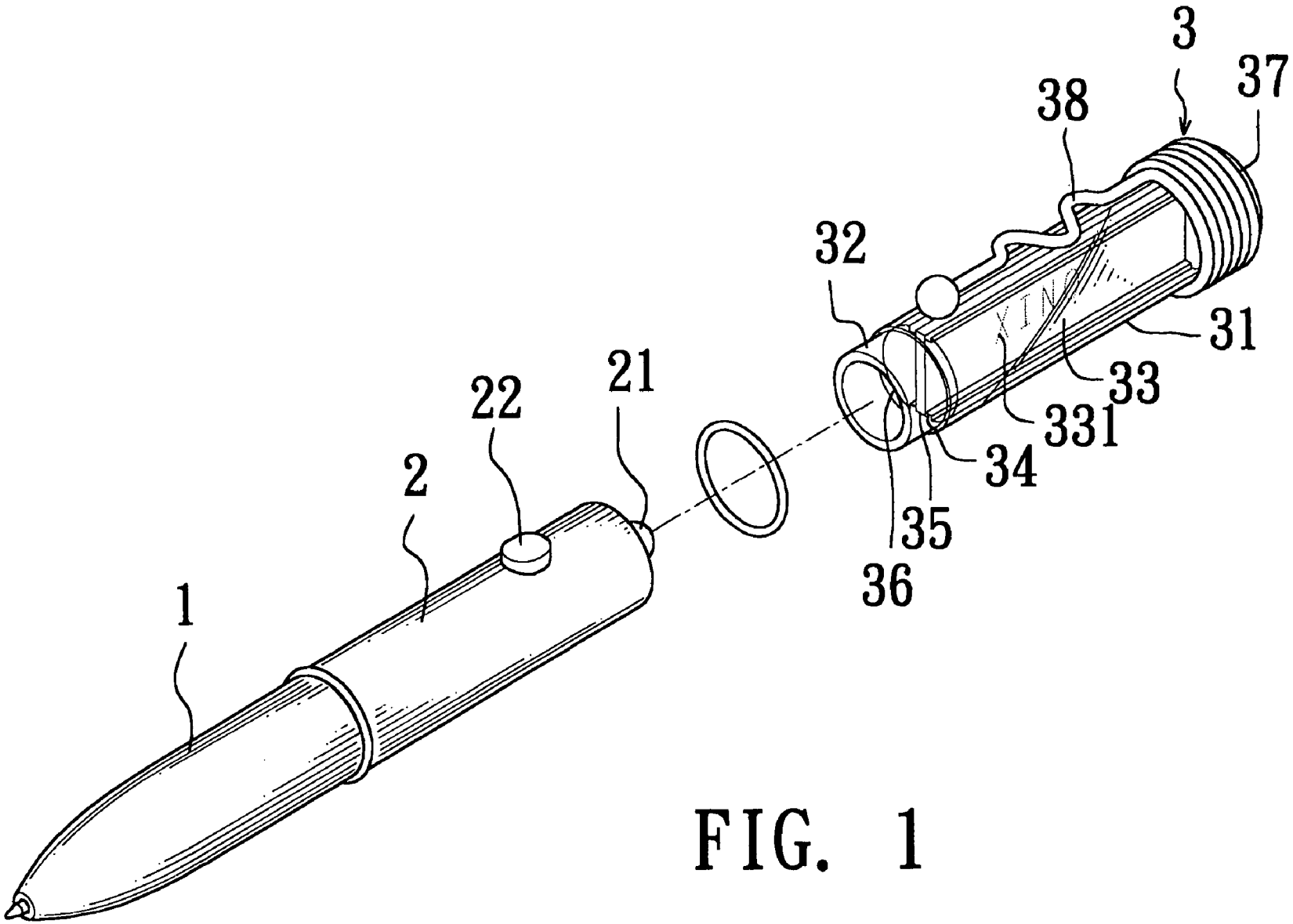
FIG. 1 is an exploded view of the lighting pen of the present invention.
Figure 2:
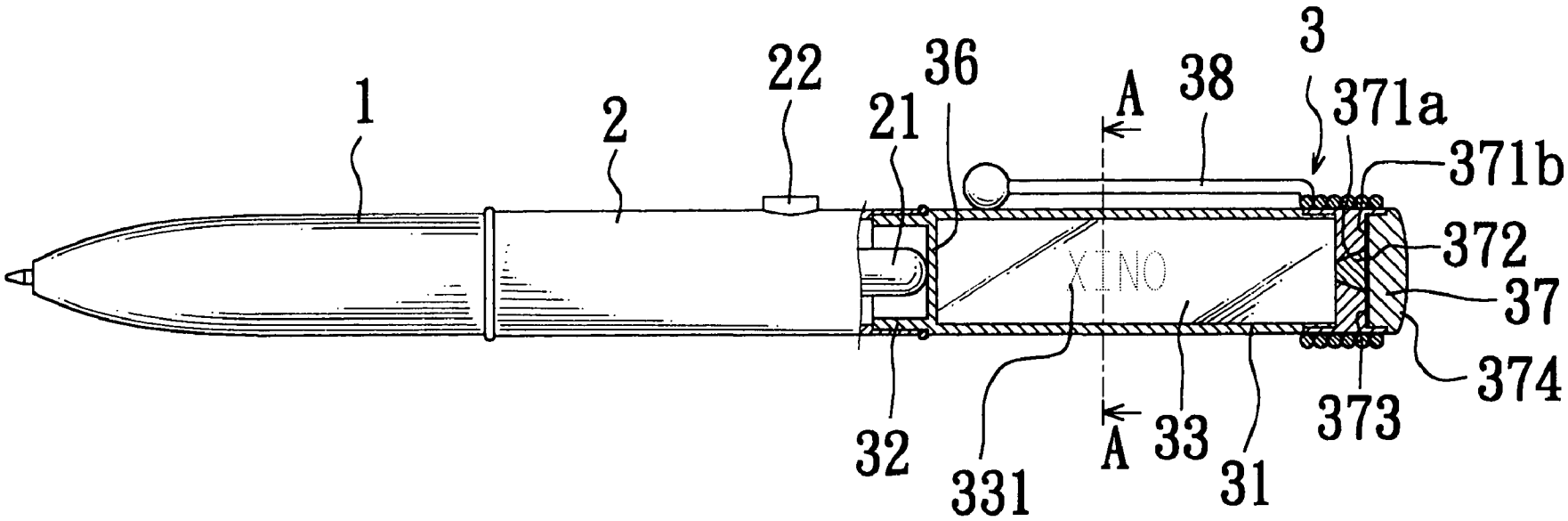
FIG. 2 is a cross-sectional view of the lighting pen of the present invention.
Figure 3:
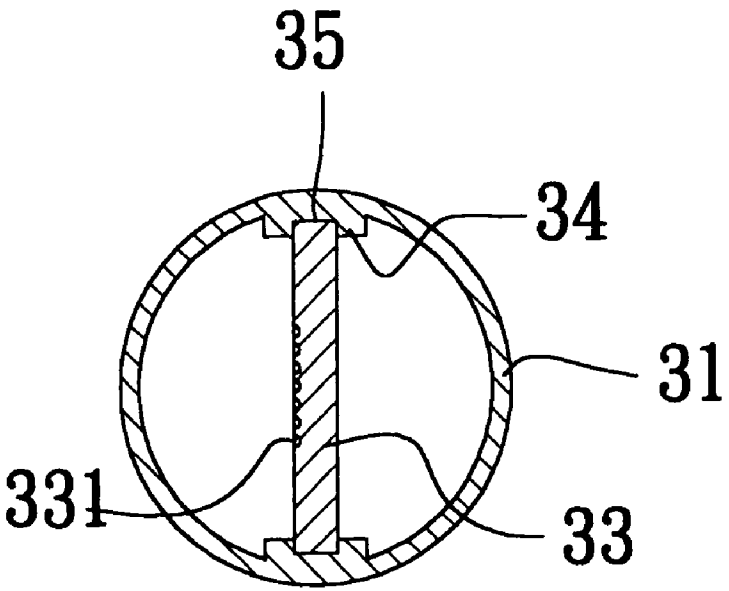
FIG. 3 is a cross-sectional view of the Section A—A as depicted in FIG. 2.

Please refer to FIGS. 1 to 3 for the lighting pen according to the present invention. The pen of the invention comprises a writing section 1, an illuminating section 2 and a displaying section 3; wherein the writing section 1 and the illuminating section 2 are prior arts as disclosed in the U.S. Design No. D 484,535, and thus will be adopted in the present invention.

The writing section 1 disposed on the bottom of the pen mainly provides a writing function, and the illuminating section 2 at the middle part of the pen further comprises a power supply, at least one illuminating member 21, a control switch 22 disposed in the circuits of the power supply and the illuminating member 21, so that the control switch 22 is controlled by pressing or touching to turn on the illuminating member 21 and project the light onto a displaying section 3 as described below. An light emitting diode (LED) is preferably adopted as the illuminating member 21 and the types of illumination includes monochrome or multiple chips with red, blue and green colors, and the modes of the illumination include a continuous type, a blinking type or a color changing type.

The displaying section 3 is a hollow tubular body 31 having a tube edge 32 protruded from one side for being embedded and fixed onto the illuminating section 2 to couple the displaying section 3 with the illuminating member 21. The technical features of the present invention reside on that a light guiding plate 33 is disposed on the inner wall of the tubular body 31 for projecting the light coming from the illuminating member 21. The light guiding plate 33 may be integrally coupled to the tubular member 31 or may have a plate groove 35 disposed between the tenons 34 protruded from the corresponding ends of the inner wall of the tubular member 31 as shown in FIG. 3 to provide a coupling effect to fix the light guiding plate 33. However, it is not limited to the foregoing arrangements, and the plate groove can also be built directly at the corresponding position on the inner wall of the tubular member 31 to obtain the coupling effect of the light guiding plate 33.

To achieve the advertising or publicity effects, the light guiding plate 33 has at least one sign on its surface as shown in the figure, and the sign 331 is a combination of dotted patterns and/or text. To make the manufacturing more convenient, the dotted patterns are recessions produced by laser engraving, so that when light is projected onto the recession of each sign 331, the light is reflected and the dotted patterns and/or text formed by the reflected light from a light guiding board 33 are produced to provide the expected advertising and/or publicity effect. Of course, the dotted patterns are not limited to the recession, but they can be protrusions as well.

Figure 4:
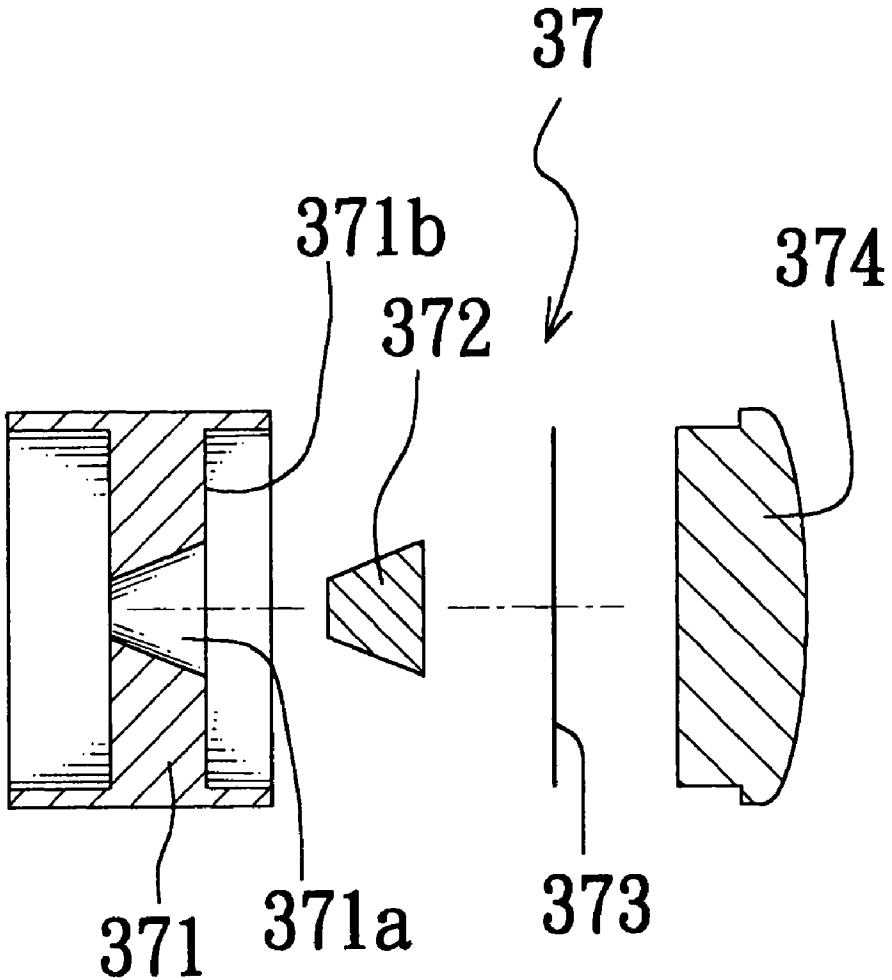
FIG. 4 is a cross-sectional view of the disassembled parts of the cap of the lighting pen according to the present invention.
Figure 5:
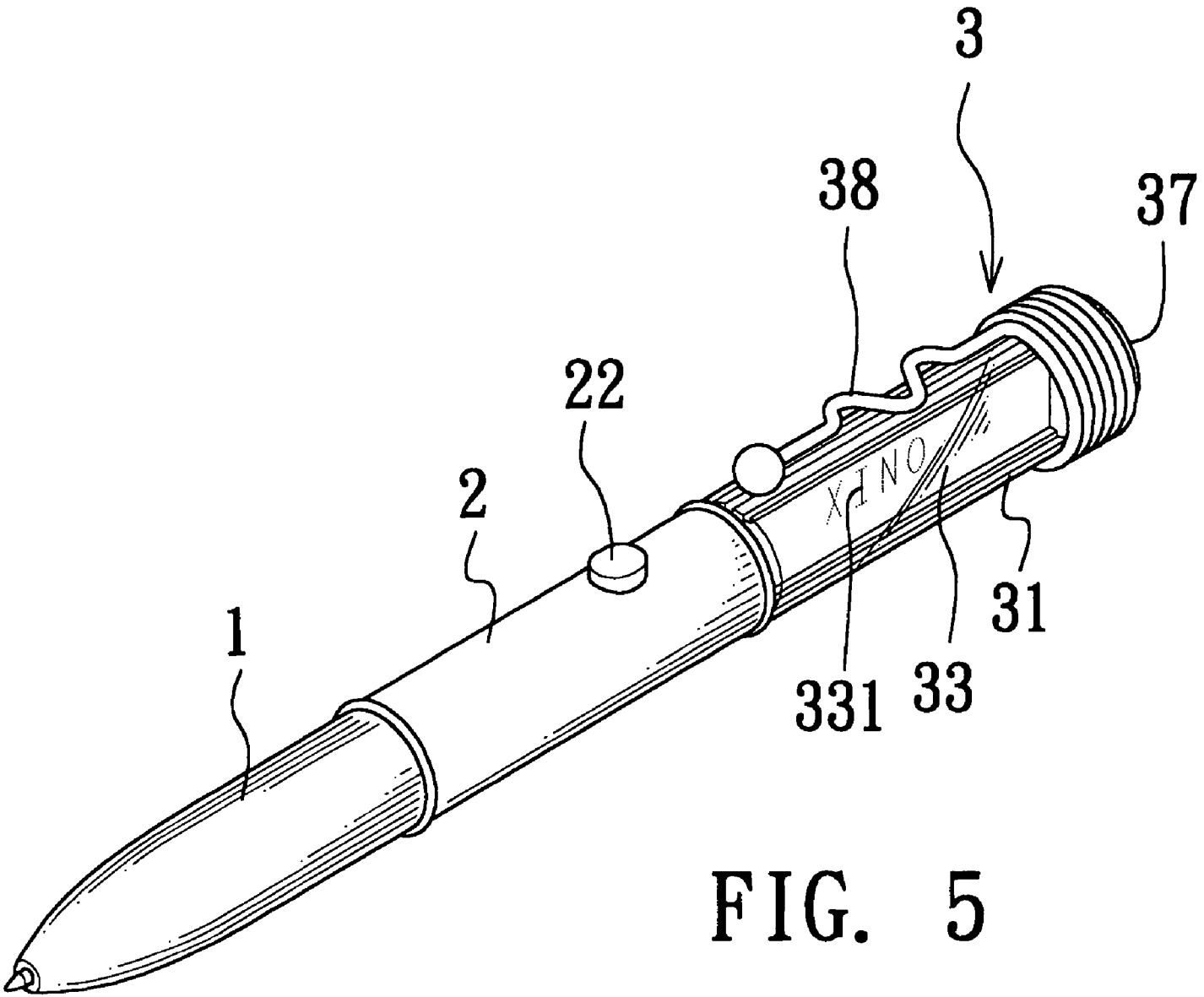
FIG. 5 is a perspective view of the lighting pen of the present invention.

Further, the tubular ember 31 has an end seal 36 coupled to the illuminating member 21, and a cap 37 on the other side seals the opening of the top of the pen. Please refer to FIG. 4 for a preferred embodiment of the invention. An end cover 371 seals the opening of the tubular member 31, and an end plug 372 plugs into a hole 371*a* of the end cover 371. The purpose of having the end plug 372 is to fill a liquid into the tubular member 31 before the hole 371*a* plugged in order to make the pen more interesting. A decorative plate 373, preferably a reflection plate, is disposed on top of a cap thread 371*b*, and then a top plate 374 is coupled to the cap thread 371*b* to complete the assembling of the cap 37. The purpose of the decorative plate 373 is to reflect the light back to the displaying section 3 and enhance the efficiency of the reflection, in addition to covering the top of the light guiding plate 33. Please refer to FIG. 5 for the perspective view of the pen according to the present invention. A pen clip 38 is disposed at the top of the displaying section 3 for facilitating the holding and clipping of the pen.

In the present invention, after the control switch is turned on and the illuminating member is lit, the signs in the form of patterns and/or text on the light guiding plate is reflected and thus maximizing the advertising or publicity effects. Further, if the illuminating member can blink or change colors, the sign will have a dynamic displaying effect, and such invention is definitely a novel good idea.

In summation of the description above, the present invention overcomes the shortcomings of the prior-art and enhances the performance than the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements.

What is claimed is:

1. A lighting pen having a writing section and an illuminating section disposed at its bottom and middle respectively, and said illuminating section being controlled by a control switch to selectively turn on and off an illuminating member, characterized in that said illuminating section being coupled to a hollow tubular member of a display section, and said tubular member having a light guiding plate disposed on an inner wall of said tubular member and at least one sign disposed on the surface of said light guiding plate; thereby after said illuminating member is lit, a light passes through said light guiding plate and reflects said light onto a predetermined position of said sign, wherein said tubular member comprises an end seal plate located on a first end thereof adjacent said illuminating section, and a seal cover located on a second end thereof, wherein said seal cover seals said opening of said tubular member with an end cover, and said end cover has a cap thread for accommodating a decorative plate, and a top seal plate is coupled to said cap thread.

2. The lighting pen of claim 1, wherein said decorative plate is a reflective plate.

3. A lighting pen having a writing section and an illuminating section disposed at its bottom and middle respectively, and said illuminating section being controlled by a control switch to selectively turn on and off an illuminating member, characterized in that said illuminating section being coupled to a hollow tubular member of a display section, and said tubular member having a light guiding plate disposed on an inner wall of said tubular member and at least one sign disposed on the surface of said light guiding plate; thereby after said illuminating member is lit, a light passes through said light guiding plate and reflects said light onto a predetermined position of said sign, an end cover sealed an opening of the tubular member, wherein said end cover further comprises a hole for being sealed by an end plug.

* * * * *